US007124557B2

(12) United States Patent
Small

(10) Patent No.: US 7,124,557 B2
(45) Date of Patent: Oct. 24, 2006

(54) VACUUM PACKAGING APPLIANCE WITH SEALING SUB-ASSEMBLY INCLUDING LATCH AND RELEASE LEVER MECHANISMS

(75) Inventor: Steven D. Small, Novato, CA (US)

(73) Assignee: Sunbean Products, Inc., Boca Raton, FL (US)

( * ) Notice: Subject to any disclaimer, the term of this patent is extended or adjusted under 35 U.S.C. 154(b) by 96 days.

(21) Appl. No.: 11/090,323

(22) Filed: Mar. 24, 2005

(65) Prior Publication Data

US 2005/0217101 A1 Oct. 6, 2005

Related U.S. Application Data

(60) Provisional application No. 60/556,225, filed on Mar. 24, 2004.

(51) Int. Cl.
*B65B 31/04* (2006.01)
*E05C 1/12* (2006.01)

(52) U.S. Cl. ..... 53/510; 53/512; 53/432; 53/314.9; 292/34; 292/163; 292/165

(58) Field of Classification Search ..... 53/510, 53/428, 432, 434, 512, 374.9; 292/32, 34, 292/37, 159, 163, 165, 167, 169
See application file for complete search history.

(56) References Cited

U.S. PATENT DOCUMENTS

| | | | | |
|---|---|---|---|---|
| 3,663,047 | A * | 5/1972 | Zawadzki | 292/92 |
| 4,344,646 | A * | 8/1982 | Michel | 292/87 |
| 4,941,310 | A * | 7/1990 | Kristen | 53/512 |
| 5,317,959 | A * | 6/1994 | Beluzzi | 99/337 |
| 5,784,862 | A * | 7/1998 | Germano | 53/512 |
| 6,648,162 | B1 * | 11/2003 | Wooderson et al. | 220/316 |
| 6,669,243 | B1 * | 12/2003 | Katoh et al. | 292/34 |
| 2003/0010216 | A1 * | 1/2003 | Yang et al. | 99/337 |
| 2005/0011166 | A1 * | 1/2005 | Germano | 53/512 |

* cited by examiner

*Primary Examiner*—Scott A. Smith
*Assistant Examiner*—Gloria R. Weeks
(74) *Attorney, Agent, or Firm*—Lawrence J. Shurupoff

(57) ABSTRACT

A vacuum packaging appliance with a sealing sub-assembly including a latching mechanism and release mechanism is described. According to certain embodiments, the release mechanism, latch and sealing sub-assembly operate in an integrated fashion such that the vacuum packaging appliance can be easily opened or sealed.

23 Claims, 7 Drawing Sheets

DETAIL A
SCALE 1.000

DETAIL B
SCALE 1.000

VACUUM PACKAGING APPLIANCE WITH SEALING SUB-ASSEMBLY INCLUDING LATCH AND RELEASE LEVER MECHANISMS

This application claims priority to U.S. Provisional Patent Application No. 60/556,225, entitled, "Vacuum Packaging Appliance with Sealing Sub-Assembly including Latch and Release Lever Mechanism" by Steven Small, filed on Mar. 24, 2004, and which is hereby incorporated by reference in its entirety

FIELD OF THE INVENTION

The present invention generally relates to vacuum packaging appliances. More particularly, the invention is directed to vacuum packaging appliances with a sealing sub-assembly including a latch and release lever mechanisms.

BRIEF DESCRIPTION OF THE DRAWINGS

The present invention is illustrated by way of example, and not by way of limitation.

DETAILED DESCRIPTION OF THE PREFERRED EMBODIMENT

A vacuum packaging appliance with a latch and release lever mechanisms is described. In the following description, for purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Figure 1:
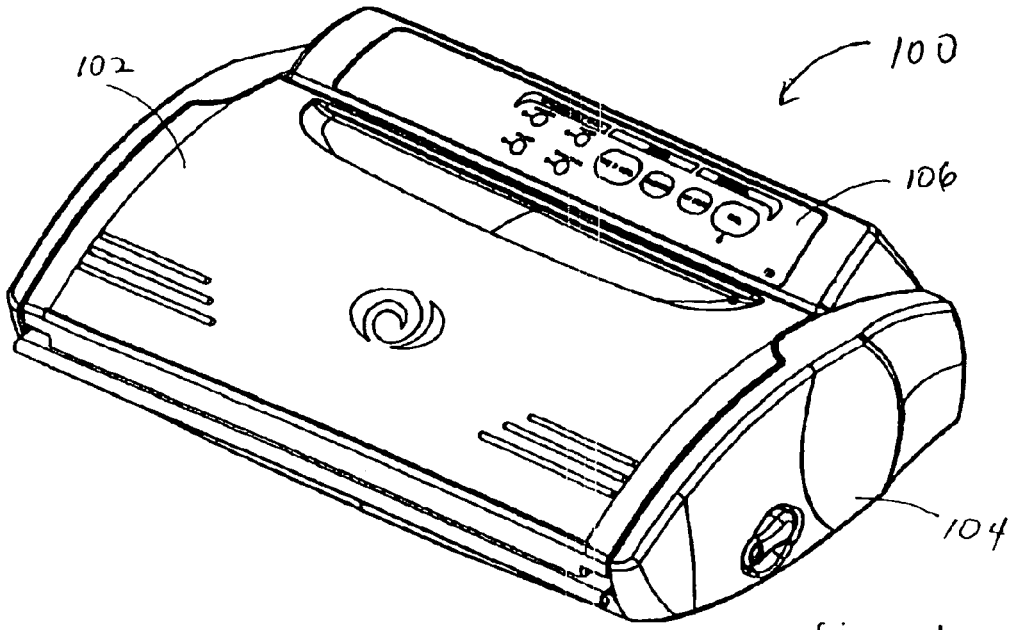
FIG. 1 is an isometric view 100 that illustrates a vacuum packaging appliance 100 with lid closed, according to certain embodiments.

FIG. 1 is an isometric view 100 that illustrates a vacuum packaging appliance 100 with lid closed, according to certain embodiments. FIG. 1 shows a lid 102 in a closed position over a base 104. FIG. 1 also shows a control panel 106 for operating the vacuum packaging appliance.

Figure 2:
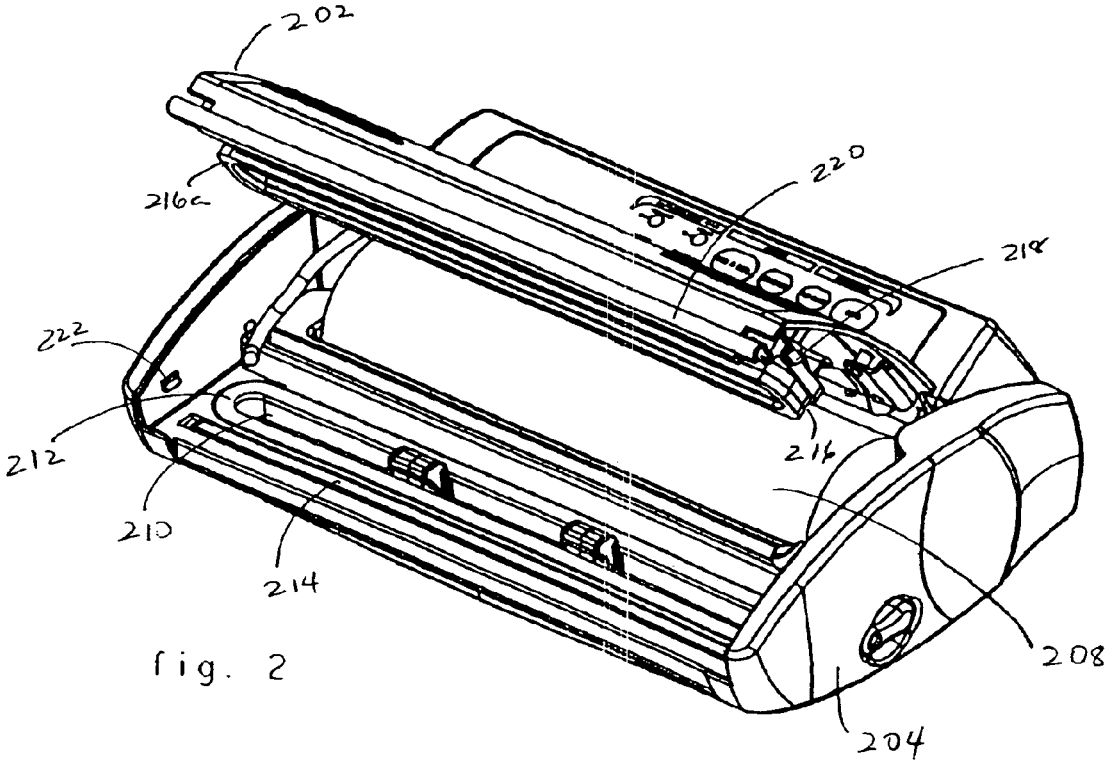
FIG. 2 is an isometric view 200 that illustrates the vacuum packaging appliance with lid partially open, according to certain embodiments.

FIG. 2 is an isometric view 200 that illustrates the vacuum packaging appliance with lid 202 in a partially open position, according to certain embodiments. Lid 202 includes a seal-assembly that is attached to the underside of lid 202. The seal assembly includes: 1) a top portion 216 of a vacuum chamber with an elastomeric seal **216*a* around the perimeter of top portion 216 of the vacuum chamber, 2) a latch mechanism 218, and 3) a release lever 220. The top portion of the vacuum chamber 216 fits over a drip tray 210 which forms the bottom portion of the vacuum chamber. Drip tray 210 has an elastomeric seal 212 around its perimeter. Base 204 includes a latch-strike 222, a sealing strip 214 and optionally includes a bag storage compartment 208**.

Figure 3:
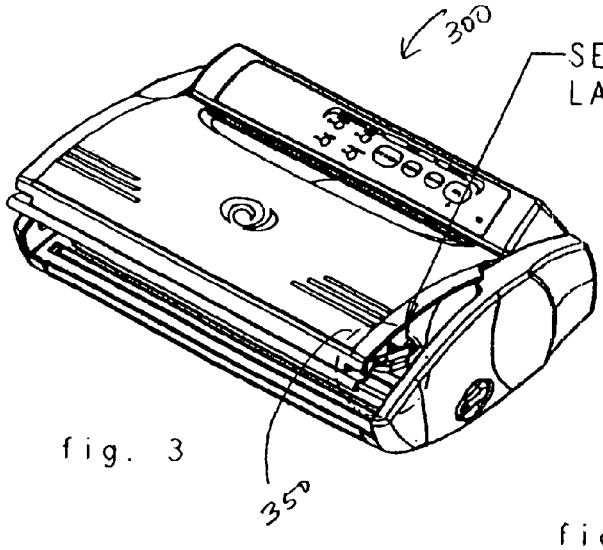
FIG. 3 is an isometric view 300 showing a latch mechanism and a section of the seal-assembly of the vacuum packaging appliance, according to certain embodiments.

FIG. 3 is an isometric view 300 showing the latch mechanism 350 and a section of the seal-assembly of the vacuum packaging appliance, according to certain embodiments.

Figure 4:
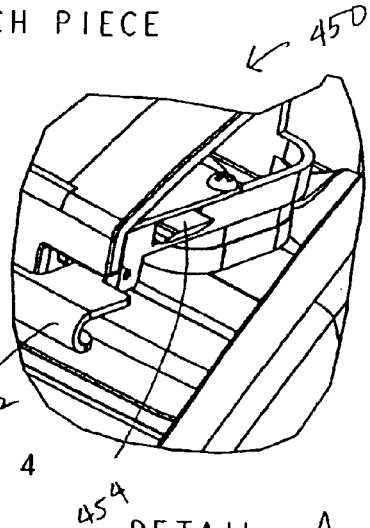
FIG. 4 is an exploded isometric view 450 of the latch mechanism and a section of the seal-assembly of FIG. 3, according to certain embodiments.

FIG. 4 is an exploded isometric view 450 of the latch mechanism and a section of the seal-assembly of FIG. 3, according to certain embodiments. FIG. 4 shows a section of lever bar 452 and latch 454. When lever bar 452 is lifted, the lever bar rotates upwards away from the base of the appliance. As the lever bar rotates upwards, the latch piece is retracted as described in greater detail herein with reference to FIGS. 11, 12, 17 and 18.

Figure 5:
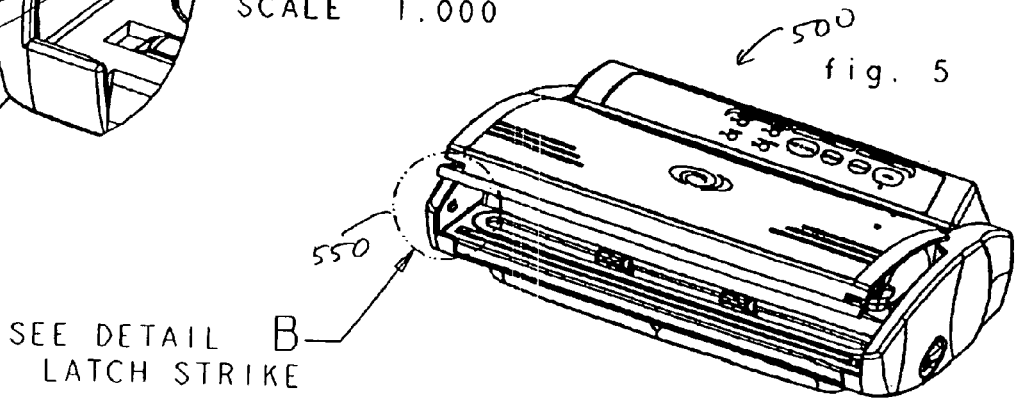
FIG. 5 is an isometric view 500 illustrating a latch-strike mechanism and a section of the seal-assembly of the vacuum packaging appliance, according to certain embodiments.

FIG. 5 is an isometric view 500 illustrating a latch-strike mechanism 550 and a section of the seal-assembly of the vacuum packaging appliance, according to certain embodiments.

Figure 6:
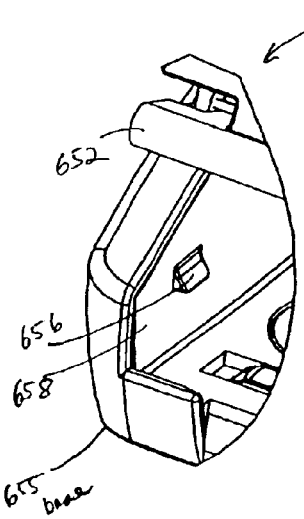
FIG. 6 is an exploded isometric view 650 of the latch-strike mechanism and a section of the seal-assembly of FIG. 5, according to certain embodiments.

FIG. 6 is an exploded isometric view 650 of the latch-strike mechanism and a section of the seal-assembly of FIG. 5, according to certain embodiments. FIG. 6 shows a section of release lever 652, a latch-strike 656 protruding through a side wall 658 of base 655 of the vacuum packaging appliance.

Figure 7:
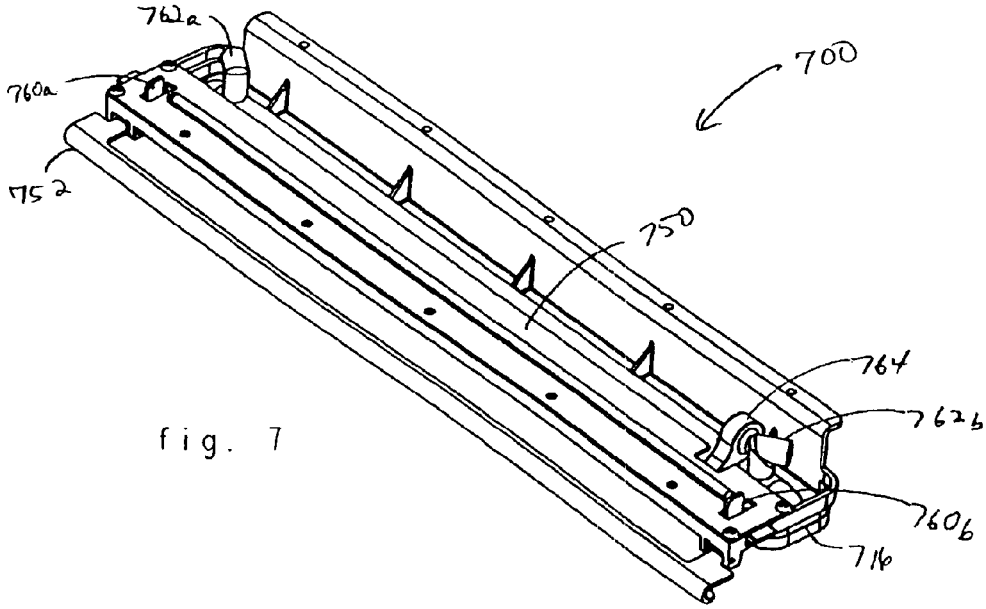
FIG. 7 is an isometric view 700 of the seal-assembly, according to certain embodiments.

FIG. 7 is an isometric view 700 of the seal-assembly, according to certain embodiments. FIG. 7 shows a cover plate 750, release lever 752, cam pieces 760*a*, 760*b* protruding through slot on cover plate 750, a vacuum release paddle 764, vacuum tube fittings 762*a*, 762*b*, and top portion 716 of the vacuum chamber 717. Cam pieces 760*a*, 760*b* are attached to release lever 752. As release lever 752 is rotated, the cam pieces are caused to rotate as explained in greater detail herein with reference to FIGS. 11, 12, 17 and 18.

Figure 8:
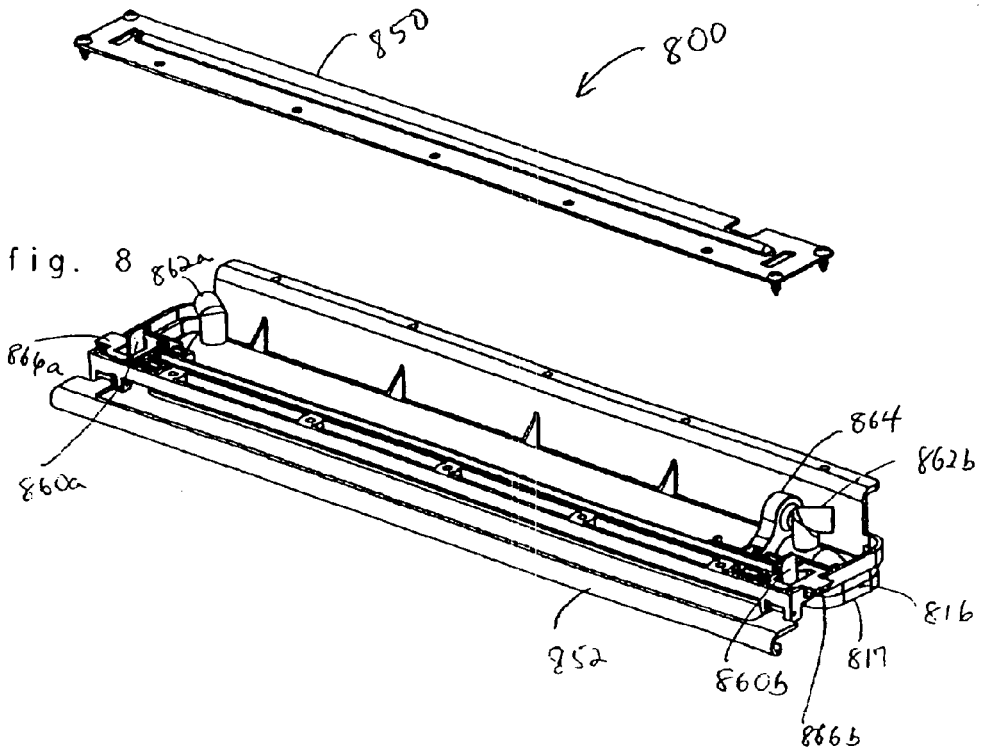
FIG. 8 is an isometric view 800 of the seal-assembly with cover plate removed, according to certain embodiments.

FIG. 8 is an isometric view 800 of the seal-assembly with cover plate 850 removed, according to certain embodiments. FIG. 8 shows release lever 852, cam pieces 860*a*, 860*b*, a vacuum release paddle 864, vacuum tube fittings 862*a*, 862*b*, top portion 816 of the vacuum chamber 817, and latches 866*a*, and 866*b*.

Figure 9:
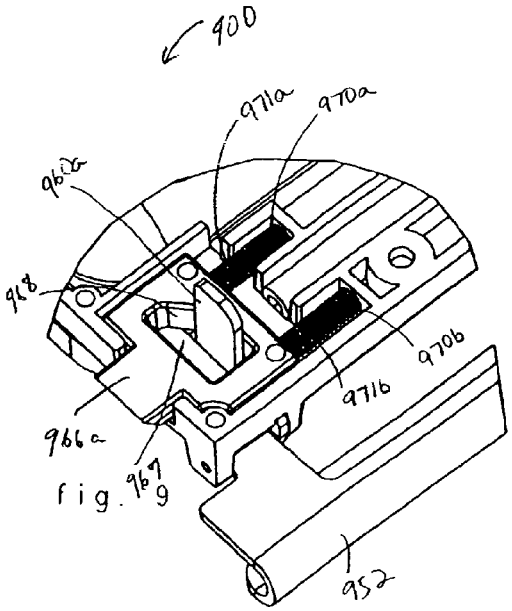
FIG. 9 is an exploded isometric view 900 of the left-hand-side latch mechanism of the vacuum packaging appliance, according to certain embodiments.

FIG. 9 is an exploded isometric view 900 of the left-hand-side latch mechanism of the vacuum packaging appliance, according to certain embodiments. FIG. 9 shows:

1) a release lever 952

2) a left-hand-side cam piece 960*a* attached to the release lever 952, 3) a left-hand-side latch 966*a* with slot 967 that has a sloped edge 968, 4) stems 971*a* and 971*b*; and 5) springs 970*a* and 970*b* covering stems 971*a* and 971*b*, respectively.

Latch 966*a* protrudes out of the seal assembly. Springs 970*a* and 970*b* are biased against latch 966*a* to keep the latch in the protruding position. The lid is locked into a closed position when the latches on the lid travel past corresponding latch-strikes (not shown in FIG. 9) on the side walls of base of the vacuum packaging appliance.

Figure 10:
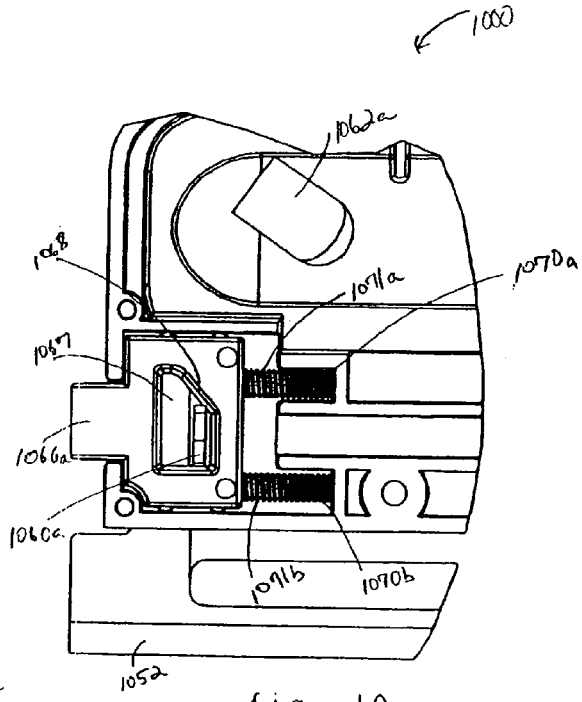
FIG. 10 is an exploded top plan view 1000 of the left-hand-side latch mechanism of the vacuum packaging appliance, according to certain embodiments.

FIG. 10 is an exploded top plan view 1000 of the left-hand-side latch mechanism of the vacuum packaging appliance, according to certain embodiments. FIG. 10 shows:

1) a release lever 1052

2) a left-hand-side cam piece 1060*a* attached to the release lever 1052, 3) a left-hand-side latch 1066*a* with slot 1067 that has a sloped edge 1068, 4) stems 1071*a* and 1071*b*, and 5) springs 1070*a* and 1070*b* covering stems 1071*a* and 1071*b*, respectively.

Further, FIG. 10 shows a left-hand-side vacuum tube fitting 1062*a*. Vacuum tube fitting 1062*a* is attached to a vacuum sensor, according to certain embodiments.

Figure 11:
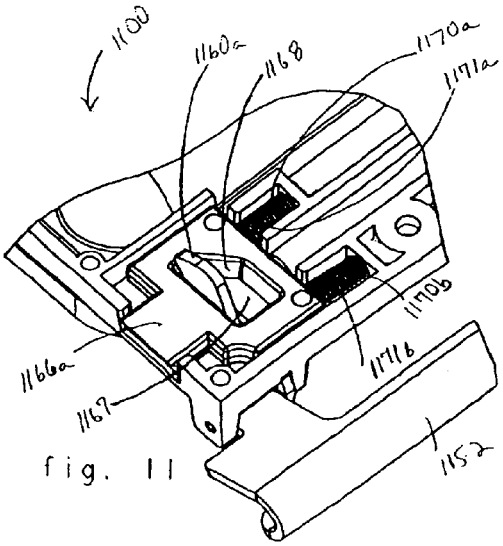
FIG. 11 is an exploded isometric view 1100 of the left-hand-side latch mechanism in a retracted position, according to certain embodiments.

FIG. 11 is an exploded isometric view 1100 of the left-hand-side latch mechanism in a retracted position, according to certain embodiments. FIG. 11 shows:

1) a release lever 1152

2) a left-hand-side cam piece 1160*a* attached to the release lever 1152, 3) a left-hand-side latch 1166*a* with slot 1167 that has a sloped edge 1168, 4) stems 1171*a* and 1171*b*, and 5) springs 1170*a* and 1170*b* covering stems 1171*a* and 1171*b*, respectively.

In FIG. 11, left-hand-side latch 1166*a* is caused to be in a retracted position when release lever 1152 is lifted, i.e., rotated upwards away from the base of the vacuum packaging appliance. When release lever 1152 is lifted, the release lever causes cam piece 1160 to impinge against sloped edge 1168. When cam piece 1160 impinges against sloped edge 1168, a side force is created that causes latch 1166*a* to push against springs 1170*a* and 1170*b*, thus positioning latch 1166*a* in a retracted position.

Figure 12:
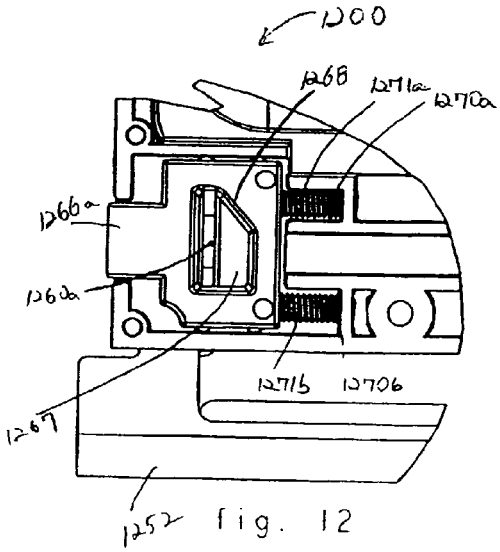
FIG. 12 is an exploded top plan view 1200 of the left-hand-side latch mechanism in a retracted position, according to certain embodiments.

FIG. 12 is an exploded top plan view 1200 of the left-hand-side latch mechanism in a retracted position, according to certain embodiments. FIG. 12 shows:

1) a release lever 1252

2) a left-hand-side cam piece 1260*a* attached to the release lever 1252, 3) a left-hand-side latch 1266*a* with slot 1267 that has a sloped edge 1268, 4) stems 1271*a* and 1271*b*, and 5) springs 1270*a* and 1270*b* covering stems 1271*a* and 1271*b*, respectively.

Figure 13:
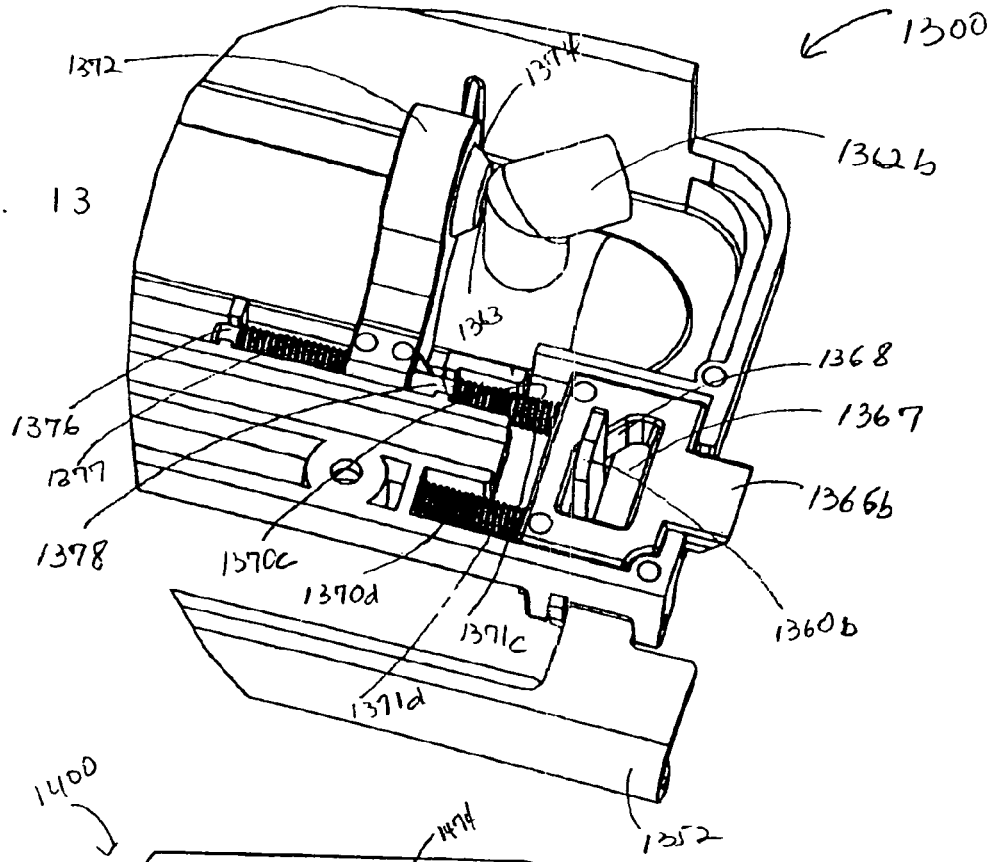
FIG. 13 is an exploded isometric view 1300 of the right-hand-side latch mechanism and a vacuum release assembly of the vacuum packaging appliance, according to certain embodiments.

FIG. 13 is an exploded isometric view 1300 of the right-hand-side latch mechanism and a vacuum release assembly of the vacuum packaging appliance, according to certain embodiments. FIG. 13 shows:

1) a release lever 1352

2) a right-hand-side cam piece 1360*b* attached to the release lever 1352, 3) a right-hand-side latch 1366*b* with slot 1367 that has a sloped edge 1368, 4) stems 1371*c* and 1371*d*, 5) springs 1370*c* and 1370*d* covering stems 1371*c* and 1371*d*, respectively, 6) a vacuum release paddle 1372 with an elastomeric pad 1374;

7) stems 1376, 1378 attached to vacuum release paddle 1372;

8) springs 1377 and 1370*c* covering stems 1376 and 1378, respectively, 9) right-hand-side vacuum tube fitting 1362*b* with aperture 1363. Vacuum tube fitting 1362*b* is attached to a vacuum pump, according to certain embodiments.

FIG. 13 shows the vacuum release paddle 1372 in a default position where elastomeric pad 1374 closes aperture 1363 of vacuum tube fitting 1362*b*. Such a default position is caused by spring 1377. Spring 1377 is biased against the vacuum release paddle 1372 and pushes the vacuum release paddle against aperture 1363 of vacuum tube fitting 1362*b*.

Figure 14:
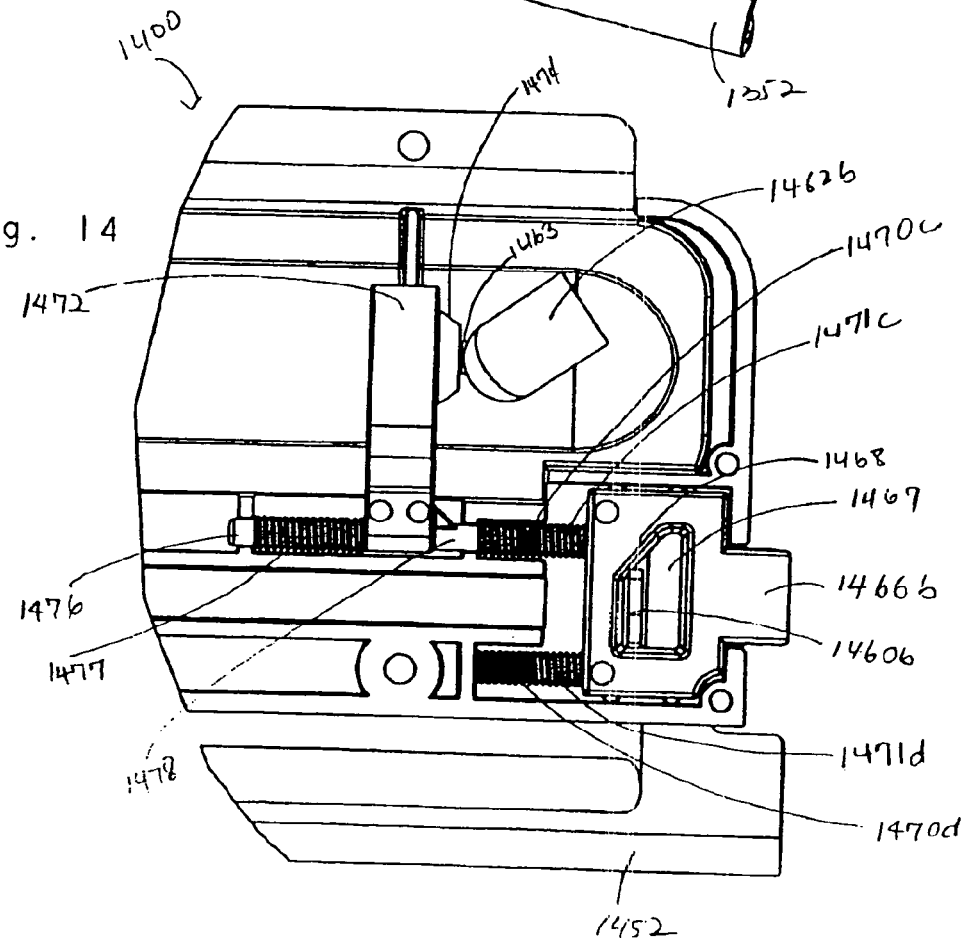
FIG. 14 is an exploded top plan view 1400 of the right-hand-side latch mechanism and the vacuum release assembly of the vacuum packaging appliance, according to certain embodiments.

FIG. 14 is an exploded top plan view 1400 of the right-hand-side latch mechanism and the vacuum release assembly of the vacuum packaging appliance, according to certain embodiments. FIG. 14 shows:

1) a release lever 1452

2) a right-hand-side cam piece 1460*b* attached to the release lever 1452, 3) a right-hand-side latch 1466*b* with slot 1467 that has a sloped edge 1468, 4) stems 1471*c* and 1471*d*, 5) springs 1470*c* and 1470*d* covering stems 1471*c* and 1471*d*, respectively, 6) a vacuum release paddle 1472 with an elastomeric pad 1474;

7) stems 1476, 1478 attached to vacuum release paddle 1472;

8) springs 1477 and 1470*c* covering stems 1476 and 1478, respectively, 9) right-hand-side vacuum tube fitting 1462*b* with aperture 1463. Vacuum tube fitting 1462*b* is attached to a vacuum pump, according to certain embodiments.

Figure 15:
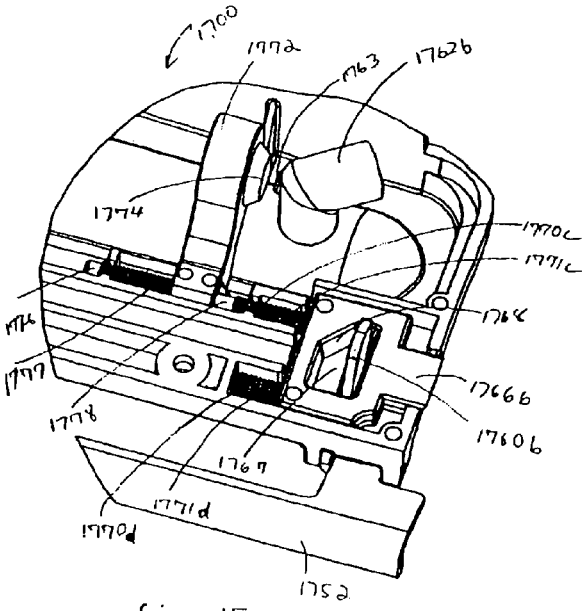
FIG. 15 is an exploded isometric view 1700 of the right-hand-side latch mechanism in a retracted position and the vacuum release assembly, according to certain embodiments.
Figure 17:
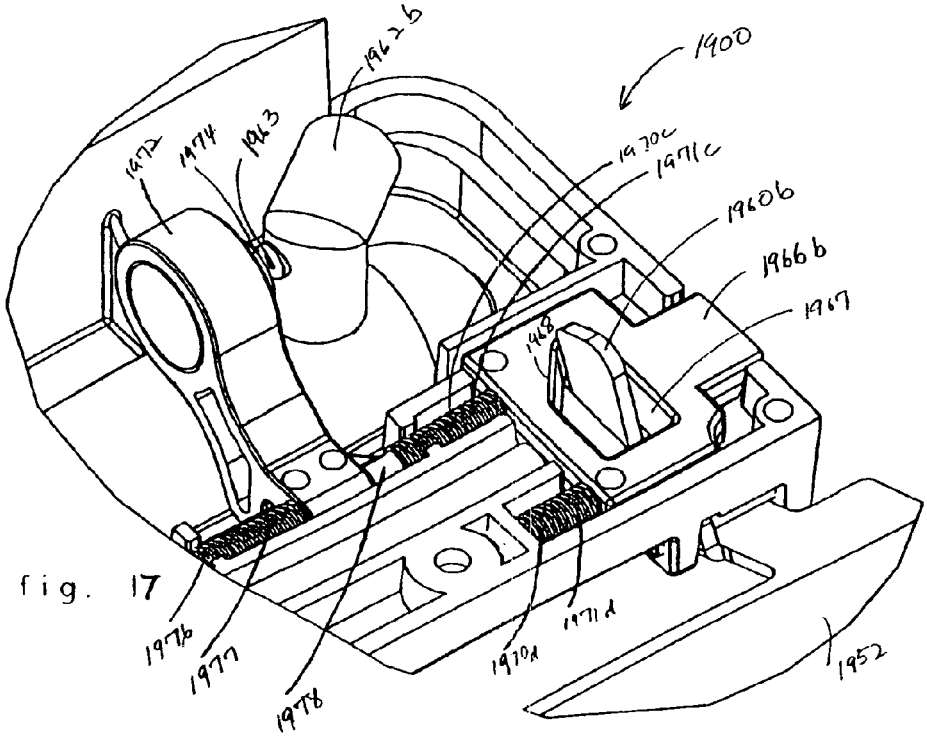
FIG. 17 is an exploded isometric view 1900 of the right-hand-side latch mechanism with the vacuum release mechanism in an open position, according to certain embodiments.

FIG. 15 is an exploded isometric view 1700 of the right-hand-side latch mechanism in a retracted position and the vacuum release assembly, according to certain embodiments. FIG. 17 shows:

1) a release lever 1752

2) a right-hand-side cam piece 1760*b* attached to the release lever 1752, 3) a right-hand-side latch 1766*b* with slot 1767 that has a sloped edge 1768, 4) stems 1771*c* and 1771*d*, 5) springs 1770*c* and 1770*d* covering stems 1771*c* and 1771*d*, respectively, 6) a vacuum release paddle 1772 with an elastomeric pad 1774;

7) stems 1776, 1778 attached to vacuum release paddle 1772;

8) springs 1777 and 1770*c* covering stems 1776 and 1778, respectively, 9) right-hand-side vacuum tube fitting 1762*b* with vent aperture 1763.

Vacuum tube fitting 1762*b* is attached to a vacuum pump, according to certain embodiments.

FIG. 15 shows the vacuum release paddle 1772 in a vacuum release position where elastomeric pad 1774 is pulled away from vent aperture 1763 of vacuum tube fitting 1762*b*. Vent aperture 1763 vents to the atmosphere outside the vacuum packaging apparatus. Such a vacuum release position is caused by lifting release lever 1752. When release lever 1752 is lifted, the release lever causes cam piece 1760*b* to impinge against sloped edge 1768. When cam piece 1760 impinges against sloped edge 1768, a side force is created that causes latch 1766*b* to push against springs 1770*c* and 1770*d*. The release lever causes cam piece 1760*b* to impinge against sloped edge 1768. In other words, when cam piece 1760*b* impinges against sloped edge 1768, a side force is created that causes latch 1766*b* to compress the springs 1770*c* and 1770*d*, thus positioning latch 1766*b* in a retracted position. When latch 1766*b* is in a retracted position, the stem 1771*c* pushes against the stem 1778, thus pushing the vacuum release paddle 1772 and corresponding elastomeric pad 1774 away from vacuum tube fitting 1762*b*.

Figure 16:
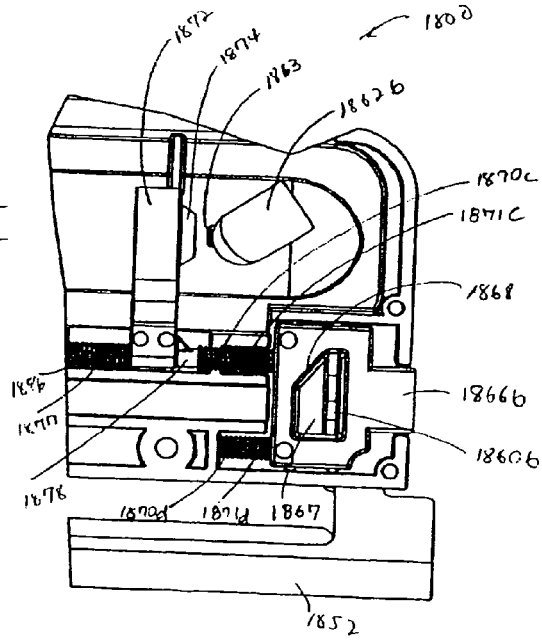
FIG. 16 is an exploded top plan view 1800 of the right-hand-side latch mechanism in a retracted position and the vacuum release assembly, according to certain embodiments.

FIG. 16 is an exploded top plan view 1800 of the right-hand-side latch mechanism in a retracted position and the vacuum release assembly, according to certain embodiments. FIG. 16 shows:

1) a release lever 1852

2) a right-hand-side cam piece 1860*b* attached to the release lever 1852, 3) a right-hand-side latch 1866*b* with slot 1867 that has a sloped edge 1868, 4) stems 1871*c* and 1871*d*, 5) springs 1870*c* and 1870*d* covering stems 1871*c* and 1871*d*, respectively, 6) a vacuum release paddle 1872 with an elastomeric pad 1874;

7) stems 1876, 1878 attached to vacuum release paddle 1872;

8) springs 1877 and 1870*c* covering stems 1876 and 1878, respectively, 9) right-hand-side vacuum tube fitting 1862*b* with aperture 1863. Vacuum tube fitting 1862*b* is attached to a vacuum pump, according to certain embodiments.

FIG. 17 is an exploded isometric view 1900 of the right-hand-side latch mechanism with the vacuum release mechanism in an open position, according to certain embodiments. FIG. 17 shows:

1) a release lever 1952

2) a right-hand-side cam piece 1960*b* attached to the release lever 1952, 3) a right-hand-side latch 1966*b* with slot 1967 that has a sloped edge 1968, 4) stems 1971*c* and 1971*d*, 5) springs 1970*c* and 1970*d* covering stems 1971*c* and 1971*d*, respectively, 6) a vacuum release paddle 1972 with an elastomeric pad 1974;

7) stems 1976, 1978 attached to vacuum release paddle 1972;

8) springs 1977 and 1970*c* covering stems 1976 and 1978, respectively, 9) right-hand-side vacuum tube fitting 1962*b* with aperture 1963. Vacuum tube fitting 1962*b* is attached to a vacuum pump, according to certain embodiments.

FIG. 17 shows the vacuum release paddle 1972 in a vacuum release position where elastomeric pad 1974 is pulled away from aperture 1963 of vacuum tube fitting 1962*b* when latch 1966*b* is in the retracted position.

Figure 18:
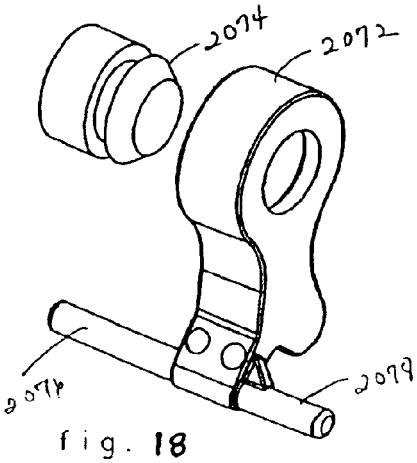
FIG. 18 and FIG. 19 are isometric views of the vacuum release assembly, according to certain embodiments.
Figure 19:
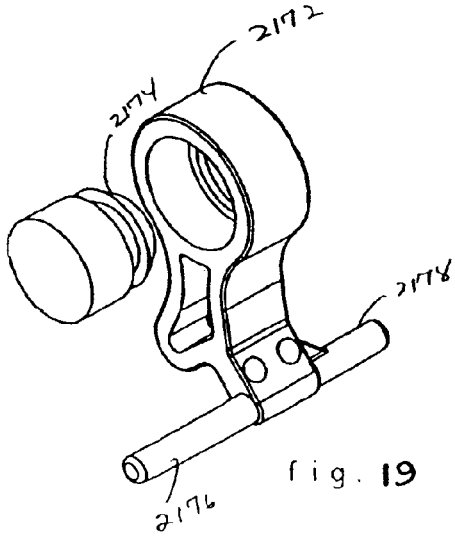

FIG. 18 and FIG. 19 are isometric views of the vacuum release assembly. FIG. 18 shows vacuum release paddle 2072 with elastomeric pad 2074, rear stem 2076 and fore stem 2078. FIG. 19 shows vacuum release paddle 2172 with elastomeric pad 2174, rear stem 2176 and fore stem 2178.

In the foregoing specification, embodiments of the invention have been described with reference to numerous specific details that may vary from implementation to implementation. The specification and drawings are, accordingly, to be regarded in an illustrative rather than a restrictive sense.

What is claimed is:

1. A vacuum packaging apparatus, said packaging apparatus comprising:

a base component;

a lid component;

wherein the lid component comprises:

a latch mechanism for latching said lid component to said base component;

a vacuum release paddle;

a release lever including a cam piece that is adapted for releasably moving a portion of said latch mechanism; and wherein said portion of said latch mechanism includes a slot having a sloped edged upon which said cam piece impinges when said lid component is released from said base component.

2. The vacuum packaging apparatus of claim 1, wherein when said release lever is lifted upwards in a same direction of rotating said lid component into an open position, said release lever causing said cam piece to retract said portion of said latch mechanism when said release lever is lifted.

3. The vacuum packaging apparatus of claim 1, wherein said latch mechanism includes a latch-strike on an inner side wall of said base component of said vacuum packaging apparatus.

4. The vacuum packaging apparatus of claim 1, wherein said latch mechanism includes a right-hand side latch-strike on a corresponding right-hand inner side wall of said base component of said vacuum packaging apparatus and a left-hand side latch-strike on a corresponding left-hand inner side wall of said base component.

5. The vacuum packaging apparatus of claim 1, wherein said portion of said latch mechanism is adapted for traveling past a corresponding latch-strike on an inner side wall of said base component for positioning said lid component in a locked position over said base component.

6. The vacuum packaging apparatus of claim 1, wherein said sloped edge is adapted such that said cam piece causes said portion of said latch mechanism to move when said cam piece impinges on said sloped edge.

7. The vacuum packaging apparatus of claim 1, further comprising at least one latch spring that is biased against said portion of said latch mechanism to maintain said portion of said latch mechanism in a protruding position wherein said protruding position is suitable for impinging on a latch-strike on an inner side wall of said base component when said lid component is being positioned in a locked position over said base component.

8. The vacuum packaging apparatus of claim 1, wherein said portion of said latch mechanism causes said vacuum release paddle to move away from a vent aperture when said portion of said latch mechanism is in a retracted position, and wherein said vent aperture vents to an ambient atmosphere outside of said vacuum packaging apparatus.

9. The vacuum packaging apparatus of claim 8, wherein said portion of said latch mechanism includes a latch member that directly impinges on a corresponding paddle member associated with said vacuum release paddle when said portion of said latch mechanism is in said retracted position.

10. The vacuum packaging apparatus of claim 1, further comprising at least one paddle spring that is biased against said vacuum release paddle to maintain said vacuum release paddle in a blocking position for blocking a vent aperture vents to an ambient atmosphere outside of said vacuum packaging apparatus.

11. The vacuum packaging apparatus of claim 10, wherein said portion includes a latch member that directly impinges on a corresponding paddle member associated with said vacuum release paddle when said portion of said latch mechanism is in a retracted position and compressing said at least one paddle spring.

12. A method for making a vacuum packaging apparatus, said method comprising:

using a latching mechanism including a movable portion having a slot with a sloped edge;

using a release lever having an attached cam piece that is movably disposed in said slot; and using a vacuum release paddle that is movably displaced in response to a movement of said movable portion.

13. The method of claim 12, wherein said cam piece operates to retract said movable portion during an operation of said release lever to unlatch a lid component of said vacuum packaging apparatus.

14. The method of claim 12, wherein when said release lever is lifted upwards in a same direction of rotating a lid component of said vacuum packaging apparatus into an open position, said release lever causes said cam piece that is attached to said release lever to retract said movable portion.

15. The method of claim 12, wherein said latching mechanism includes a latch-strike on an inner side wall of a base component of said vacuum packaging apparatus.

16. The method of claim 12, wherein said latching mechanism includes a right-hand side latch-strike on a corresponding right-hand inner side wall of a base component of said vacuum packaging apparatus and a left-hand side latch-strike on a corresponding left-hand inner side wall of said base component.

17. The method of claim 12, wherein said movable portion travels past a corresponding latch-strike on an inner side wall of a base component of said vacuum packaging apparatus for positioning a lid component of said vacuum packaging apparatus in a locked position over said base component.

18. The method of claim 12, wherein said sloped edge is adapted such that said cam piece that is attached to said release lever causes said movable portion to move when said cam piece impinges on said sloped edge.

19. The method of claim 12, further comprising at least one latch spring that is biased against said movable portion to maintain said movable portion in a protruding position wherein said protruding position is suitable for impinging on a latch-strike on an inner side wall of a base component of said vacuum packaging apparatus when a lid component of said vacuum packaging apparatus is being positioned in a locked position over said base component.

20. The method of claim 12, wherein said movable portion causes said vacuum release paddle to move away from a vent aperture when said movable portion is in a retracted position, and wherein said vent aperture vents to an ambient atmosphere outside of said vacuum packaging apparatus.

21. The method of claim 20, wherein said movable portion includes a latch member that directly impinges on a corresponding paddle member associated with said vacuum release paddle when said movable portion is in said retracted position.

22. The method of claim 12, further comprising at least one paddle spring that is biased against said vacuum release paddle to maintain said vacuum release paddle in a blocking position for blocking a vent aperture that vents to an ambient atmosphere outside of said vacuum packaging apparatus.

23. The method of claim 22, wherein said movable portion includes a latch member that directly impinges on a corresponding paddle member associated with said vacuum release paddle when said movable portion is in a retracted position and compressing said at least one paddle spring.

* * * * *